US005210908A

United States Patent [19]

Bucher

[11] Patent Number: 5,210,908

[45] Date of Patent: May 18, 1993

[54] WINDOW STAY

[75] Inventor: Albert G. Bucher, Masterton, New Zealand

[73] Assignee: Interlock Industries Limited, Miramar, New Zealand

[21] Appl. No.: 865,486

[22] Filed: Apr. 9, 1992

[30] Foreign Application Priority Data

Apr. 9, 1991 [NL] Netherlands ..... 237761

[51] Int. Cl.[5] ..... E05D 11/00; E05D 15/00

[52] U.S. Cl. ..... 16/368; 16/342; 16/346; 403/163

[58] Field of Search ..... 16/193, 342, 346, 368, 16/364, 341; 403/162, 163

[56] References Cited

U.S. PATENT DOCUMENTS 3,797,169 3/1974 Armstrong ..... 16/341
4,674,149 6/1987 Vetter ..... 16/341
4,718,144 1/1988 Buckley ..... 16/341
4,930,185 6/1990 Hutton ..... 16/341

*Primary Examiner*—W. Donald Bray
*Attorney, Agent, or Firm*—Oblon, Spivak, McClelland, Maier & Neustadt

[57] ABSTRACT

The window stay comprises a frame mounting plate, a sash mounting plate, a first arm and a second arm. The arms are pivotally coupled between the frame and sash mounting plates via pivots. The first arm is shorter than the second arm. The stay further includes a third arm which is pivotally coupled to the sash mounting plate at a pivot located to the side of pivot coupling which is opposite to pivot coupling of the first arm to the sash mounting plate. This third arm is pivotally coupled to a fourth arm with the fourth arm being pivotally coupled to the frame mounting plate. The first, second and fourth arms include structures which engage with stops associated with the frame and sash mounting plates when the stay is in the fully open position.

14 Claims, 2 Drawing Sheets

WINDOW STAY

BACKGROUND OF THE INVENTION

1. Field of Invention

This invention relates to a window stay.

2. Discussion of the Background

There is a move internationally toward projected side hung windows. That is windows where the sash is mounted with the window frame via stays at the side or top and bottom such that when the window opens the sash projects from the frame. Such construction provide for tall window sashes which can be conveniently opened for ventilation and which enables the exterior surface of the glass to be cleaned by gaining access thereto by reaching around the "hinge" side of the fully opened sash.

Improved access for cleaning is achieved by opening the window sash up to 90°. This has traditionally been achieved by the use of friction stays which incorporate a sliding shoe component. However, a drawback with such stays is that the sliding shoe tends to jam up at 90° opening due to the geometry of the stay in conjunction with the operation of the sliding shoe in a dirty environment. The latter is especially so in a casement window with the stay mounted on the window sill.

The development of sealed friction bearings has resulted in window stays able to effectively operate in such dirty environments.

With a move toward wider window sashes (for example 600mm to 900mm wide) the strength requirements for window stays able to support and control such sashes have increased. The increased strength characteristics can be achieved by increasing the thickness of the stay components and more particularly the arm(s). While this can sometimes lead to difficulties accommodating this stay in the cavity between the sash and frame, the overriding concern can be the rise in manufacturing costs and hence cost to the end user. Therefore there is an opportunity to provide a window stay which is able to carry wider sashes yet is economical to manufacture.

There is also a problem with wind gust causing wide sashes to be slammed open or closed, leading to destruction of the stays and/or the sash and glass. To overcome this the friction level in the bearings can be increased. However, the friction level required to prevent a sash moving in a wind gust of say 20 m/s (45 mph) the resistance to movement is such that the sash cannot be readily moved by a person in order to open or close the sash. There is thus a need for a window stay which can be used to support a sash so that it will not move in the wind, yet can be easy to move by hand which results in an obvious conundrum as achieving one criteria generally leads to an inability to achieve the other.

SUMMARY OF THE INVENTION

The object of the present invention is to provide a window stay construction which goes some way to achieving a window stay meeting the aforementioned criteria.

Broadly the present invention includes of a window stay comprising a frame mounting plate, a sash mounting plate, first and second arms pivotally coupled between the frame and sash mounting plates, the first arm being shorter than the second arm, the stay being characterized in that a third arm is pivotally coupled to the sash mounting plate at a point to one side of the pivot coupling of the second arm to the sash mounting plate which is opposite to that at which the first arm is pivotally coupled to the sash mounting plate, said third arm being pivotally coupled to a fourth arm, said fourth arm being pivotally coupled to said frame mounting plate.

Preferably in one form of the invention the third arm is appreciably longer than the fourth arm.

Preferably in one form of the invention the third arm is longer than the second arm.

Preferably the pivot coupling of the second and fourth arms to the frame mounting plate are closer together than the pivot coupling of the first and second arms to the frame mounting plate.

Preferably the distance between the pivot coupling of the first and second arms to the sash mounting plate is less than the length of the first arm.

Preferably a portion of the third arm extends beyond the pivot coupling of the third arm to the fourth arm, the portion of the third arm having a stop element which engages with the fourth arm when the stay is in a fully opened position.

Preferably the frame mounting plate carries a stop which engages with a portion of the first arm when the stay is in the fully opened position.

Preferably the sash mounting plate carries a stop which engages with a portion of the second arm when the stay is in the fully opened position.

Preferably the pivot coupling of the second arm to the sash mounting plate lies between the pivot couplings of the first arm to the frame and sash mounting plates when the stay is in the closed position.

Preferably a plastics material base is mounted with said frame mounting plate and projects at least from the end of the frame mounting plate nearest the pivot coupling of the first arm to the frame mounting plate and to the side of the frame mounting plate over which the arms project when the stay is opened.

Preferably the pivot couplings are all of a friction type.

Preferably the arms and frame and sash mounting plates are constructed from stainless steel.

DESCRIPTION OF THE PREFERRED EMBODIMENTS

The stay comprises a frame mounting plate 10 and a sash mounting plate 11 both of which in the preferred form of the invention are constructed from stainless steel material. The first arm 12 is pivotally coupled by pivots 14*a* and 14*b* to the frame and sash mounting plates respectively. As illustrated, pivots 14*a* and 14*b* are located at or immediately adjacent the ends of the frame plate 10 and sash plate 11.

Second arm 13 is pivotally mounted at its ends to the frame and sash mounting plates via pivots 14*c* and 14*d* respectively. As illustrated, the distance between pivots 14*b* and 14*d* is less than the length of arm 12. Also the distance between pivots 14*a* and 14*c* is less than the length of arm 13. Therefore when the stay is in the closed position, pivot 14*d* is located between pivots 14*a* and 14*b*.

Figure 2:
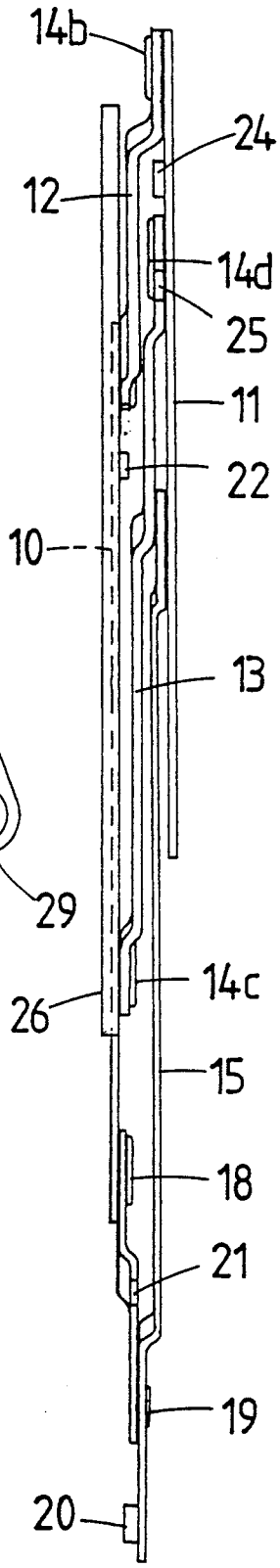
FIG. 2 is a side view of the stay shown in FIG. 1.

Arms 12 and 13 are cranked (see FIG. 2) adjacent the ends which are coupled to the sash mounting plate 11. As a result the cranked end of arm 13 can overlie arm 12.

Figure 1:
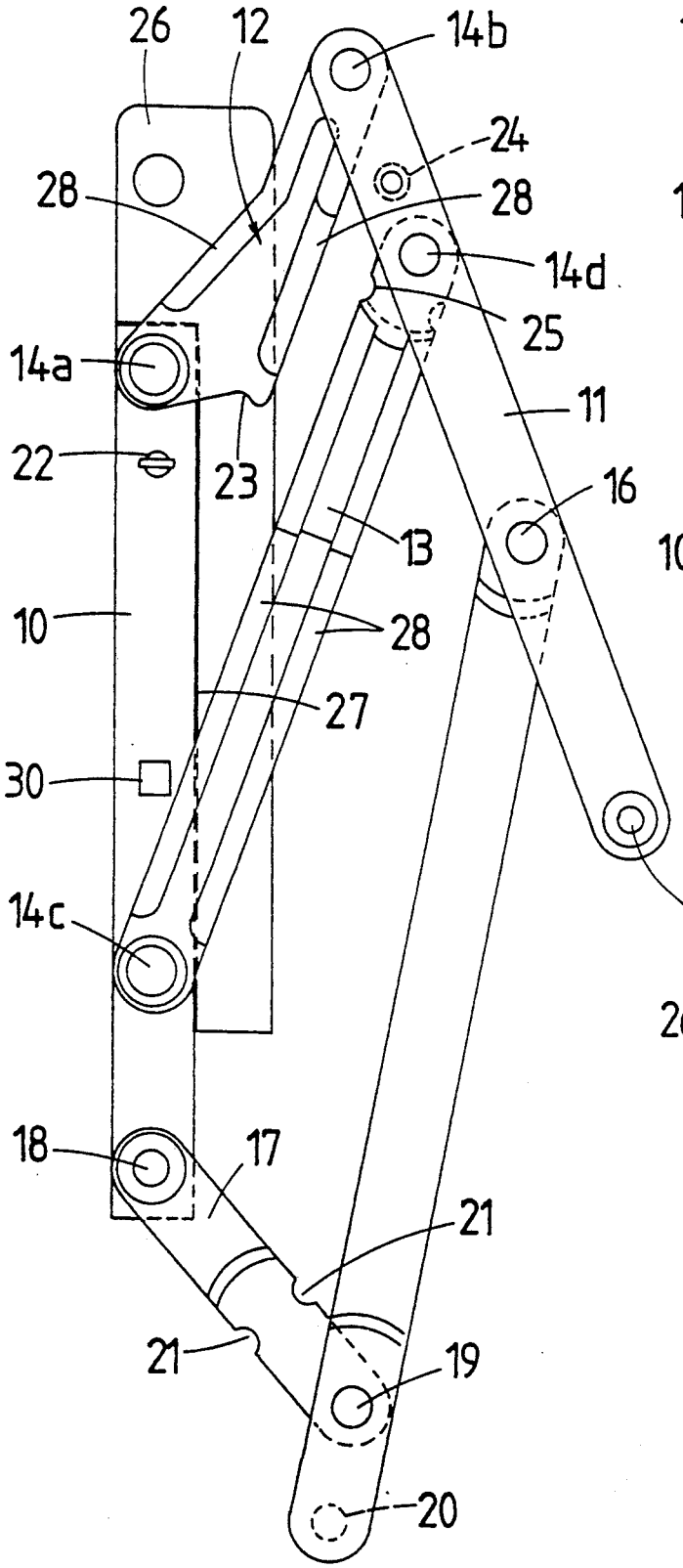
FIG. 1 is an elevation view of the stay in a slightly opened position.

Arms 12 and 13 are also preferably constructed of a stainless steel material. Preferably, arms 12 and 13 have edge ribs 28 pressed therein (see FIG. 1) for the purposes of increased strength.

A third arm 15 is pivotally coupled, by pivot coupling 16, to sash mounting plate 11. A fourth arm 17, which is of appreciably less length than arm 15 is pivotally coupled by pivot 18 to frame mounting plate 10. Arms 15 and 17 (which are also preferably of stainless steel construction) are pivotally coupled together at pivot 19. Preferably one arm (third arm in the illustrated form the third arm) extends beyond pivot 19.

Figure 3:
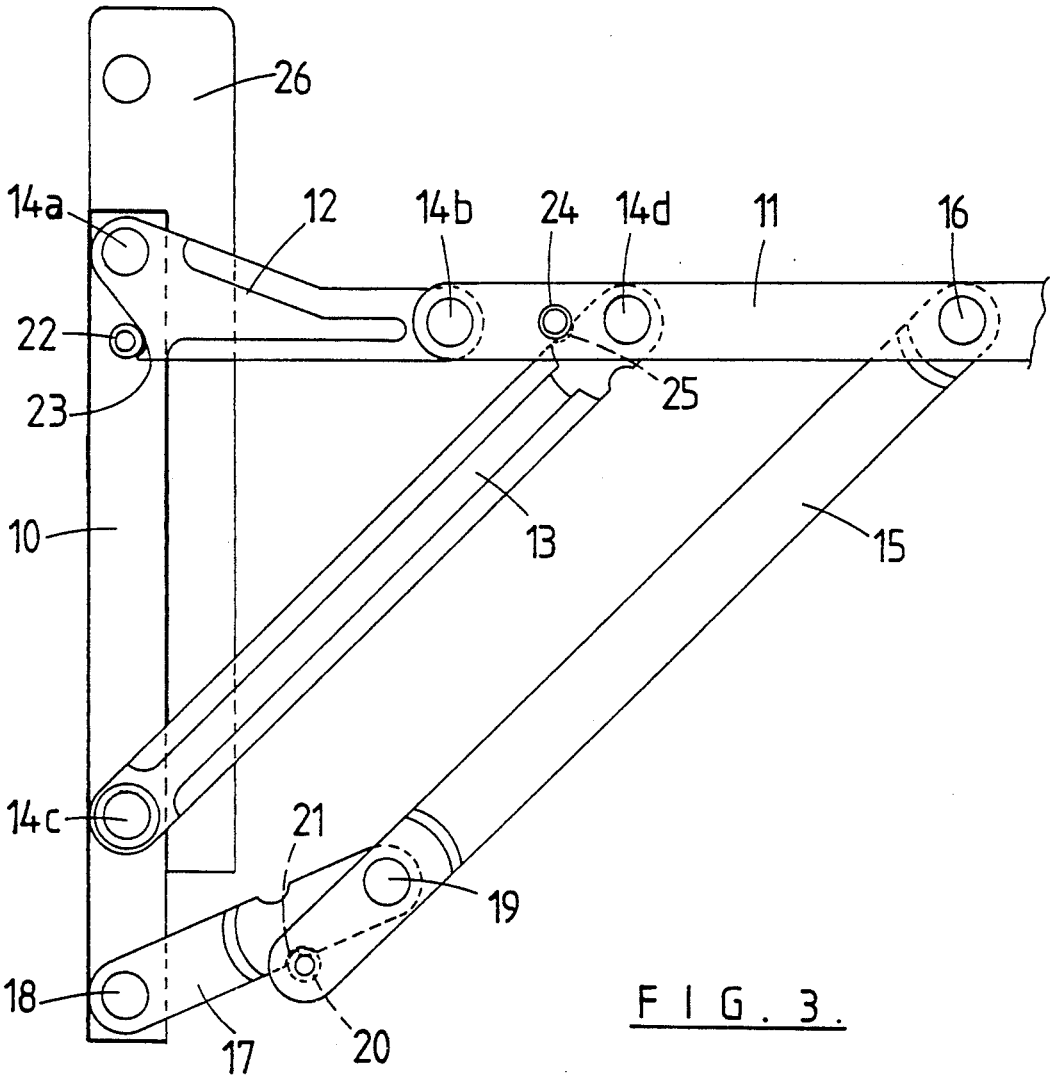
FIG. 3 is an elevation view of the stay in the fully opened position.

Stops (as hereinafter described) limit the extent to which the stay can be open (see FIG. 3). In the preferred form of the invention three separate stops are incorporated.

The first stop is a spigot 2 which projects from the surface of frame mounting plate 10. Spigot 22 is formed out of the parent metal. Spigot 22 engages with a hook shaped portion 23 formed in arm 12.

The second stop is upstanding spigot 24 of sash mounting plate 11. Spigot 24 is positioned between pivots **14*b* and 14*d*. When the stay is fully opened stop 24 engages in a curved recess 25 in the edge of arm 13**.

The third stop is a projection 20 located at the end of arm 15. Projection 20 engages in a recess 21 in fourth arm 17.

Mounted with frame mounting plate 10 is a base member 26 which is formed out of a plastics material, for example acetal. This base member 26 provides support for the short arm 12 especially when the stay is used in a casement window application. Base member 26 has a recess 27 into which frame mounting plate 10 engages. Base member 26 and frame mounting plate 10 are coupled together in a snap lock type arrangement by suitable lugs 30 and/or clips which project from the recess 27 and engage in suitably shaped openings in frame mounting plate 10.

Frame and sash mounting plates 10 and 11 are mounted to the respective frame and sash of a window construction by suitable mechanical fasteners. For example, openings 29 in sash mounting plate 11 can be provided for this purpose. However, pivot couplings **14*a*–14*d*** are preferably hollow and the mechanical fastenings can pass through the centres of the pivots.

The pivot joints can be of the type disclosed in U.S. Pat. Nos. 3497909, 4441835, 4582435/4721406 and British patent specification 2237059. These pivot joints are preferably of the friction type. Also the pivot joints are preferably hollow so that fixing screws can be located directly through the bearings at the end of the arms and into the window sash and frame sections. This ensures an extremely strong installation. The stay does not therefore depend on riveted joints for it to maintain its integrity.

In use, the window stay provides an effective means of mounting a window sash and more particularly a wide sash. The geometry of the stay and the level of friction supplied by the four arms and their pivot joints respectively enable the window to be held open in all open positions. The third and fourth arms together with the three stops ensure that there is a well defined fully opened position of the stay. Arms 15 and 17 are located sufficiently far from the "hinge end" of the stay to provide a strong controlling and stopping action.

Thus if in windy conditions the window is blown open, the extent to which the window can open is controlled. Window stays are inherent flexible especially when the thickness of material is kept to a minimum. The three separate stops not only spread the stop load but also make allowance for this flexibility. Therefore the window stay ensures the window sash is restricted to a particular fully opened position.

In the preferred form of the invention the pivot bearings are all of a friction type. Thus the seven friction bearings ensure that the sash does not slam open or shut in wind gusts but moves relatively slowly, e.g. much as does a door controlled by an hydraulic door closer.

Even though the closeness of pivots **14*b* and 14*d* does lead to a reduced cantilever effect arms 15 and 17** provide the extra control to enable the stay to carry wide sashes.

In some market sectors, there is a requirement for lower friction so that the effort necessary to move the window sash between the fully opened and fully closed positions can be kept as low as possible. This results in the window sash being more likely to slam shut or move to the fully opened position in high winds or violent wind gusts. With the present invention the stay can be designed for lower friction levels and be permitted to move to a fully opened position in such situations, however, as the fully opened position is restricted in the manner described damage is minimized if the sash does slam fully open.

In the preceding disclosure the frame and sash mounting plates have been described as each being of one piece. However, as is known the plates or one thereof can be formed by a plurality of separate plates, e.g. a mounting plate attached to each of arms 12, 13 and 15 via pivots **14*b*, 14*d* and 16** respectively.

Alternatively in a window construction technique the arms can be mechanically fastened directly into the sash and/or frame sections of the window.

What is claimed is:

1. A window stay comprising:

a frame mounting plate;

a sash mounting plate;

a first arm pivotally coupled between the frame and sash mounting plates;

a second arm, longer than said first arm, pivotally coupled between the frame and sash mounting plates;

a third am pivotally coupled to the sash mounting plate such that said second arm is pivotally coupled to the sash mounting plate between said first arm and said third arm; and a fourth arm pivotally coupled to both said frame mounting plate and said third arm.

2. A window stay as claimed in claim 1 wherein the third arm is appreciably longer that the fourth arm.

3. A window stay as claimed in claim 1 or 2 wherein the third arm is longer than the second arm.

4. A window stay as claimed in claim 1 or 2 wherein the pivot coupling of the second and fourth arms to the frame mounting plate are closer together than the pivot couplings of the first and second arms to the frame mounting plate.

5. A window stay as claimed claim 1 or 2 wherein the distance between the pivot coupling of the first and second arms to the sash mounting plate is less than the length of the first arm.

6. A window stay as claimed in claim 1 wherein each of the first, second and fourth arms include engagement means which engage with stop means associated with the frame, sash and third arm respectively when the sash moves to its fully open position.

7. A window stay as claimed in claim 1 wherein a plastics material base is mounted with said frame mounting plate and projects at least from the end of the frame mounting plate nearest the pivot coupling of the first arm to the frame mounting plate and to the side of the frame mounting plate over which the arms project when the stay is opened.

8. A window stay as claimed in claim 1 or 2 wherein each of the first, second and fourth arms include engagement means which engage with stop means associated with the frame mounting plate, sash mounting plate and third arm when the stay moves to the fully open position.

9. The window stay as claimed in claim 1 wherein each of the pivot couplings of the arms to the frame and sash mounting plates and the pivot coupling between the third and fourth arms are friction joints.

10. A window construction having a window frame and a window sash, the window sash being adjustably mounted in the frame by a pair of window stays each comprising:

a first arm pivotally coupled at one end to the frame and at the other end of the sash;

a second arm, longer than said first arm, pivotally coupled at a first end to the frame and at a second end to the sash;

a third arm pivotally coupled to the sash such that the second arm is pivotally coupled to the sash between said first arm and said third arm; and a fourth arm pivotally coupled to both the frame and to said third arm.

11. The window construction of claim 10 wherein the arms are coupled to the respective sash and frame via sash and frame mounting plates.

12. The window construction of claim 10 or 11 wherein each of the first, second and fourth arms includes engagement means which engage with stop means associated with the frame, sash and third arm respectively when the sash moves to its fully open position.

13. The window construction of claim 10 wherein each of the pivot couplings of the arms to the frame and sash and the pivot coupling between the third and fourth arms are friction joints.

14. The window construction of claim 10 wherein the pivot coupling of the second arm to the sash lies between the pivot couplings of the first arm to the frame and sash when the sash is in the closed position.

* * * * *

UNITED STATES PATENT AND TRADEMARK OFFICE

CERTIFICATE OF CORRECTION

PATENT NO. : 5,210,908

DATED : May 18, 1993

INVENTOR(S) : Albert G. Bucher

It is certified that error appears in the above-identified patent and that said Letters Patent is hereby corrected as shown below:

On the title page, Item [30],

The Foreign Application Priority Data is incorrect, should read:

--Apr. 9, 1991 [NZ] New Zealand.....237761--

Signed and Sealed this

Fourteenth Day of December, 1993

*Attest:*

Bruce Lehman

BRUCE LEHMAN

*Attesting Officer*

*Commissioner of Patents and Trademarks*